US008402681B2

(12) United States Patent
Kusunoki

(10) Patent No.: US 8,402,681 B2
(45) Date of Patent: Mar. 26, 2013

(54) CLOTH PIECE TREATING APPARATUS

(75) Inventor: Toshihiko Kusunoki, Takamatsu (JP)

(73) Assignee: Purex Co., Ltd. (JP)

( * ) Notice: Subject to any disclaimer, the term of this patent is extended or adjusted under 35 U.S.C. 154(b) by 247 days.

(21) Appl. No.: 13/058,416

(22) PCT Filed: Feb. 17, 2009

(86) PCT No.: PCT/JP2009/052670

§ 371 (c)(1),
(2), (4) Date: Feb. 10, 2011

(87) PCT Pub. No.: WO2010/021157

PCT Pub. Date: Feb. 25, 2010

(65) Prior Publication Data

US 2011/0131844 A1 Jun. 9, 2011

(30) Foreign Application Priority Data

Aug. 19, 2008 (JP) ..... 2008-210221

(51) Int. Cl.
*D06F 71/38* (2006.01)
*D06F 69/00* (2006.01)

(52) U.S. Cl. ..... 38/143; 223/37

(58) Field of Classification Search ..... 38/143, 38/144, 44, 1 C, 1 D; 223/37
See application file for complete search history.

(56) References Cited

U.S. PATENT DOCUMENTS

| | | | | |
|---|---|---|---|---|
| 3,706,450 | A * | 12/1972 | Gerstenberger et al. | 493/14 |
| 4,378,645 | A * | 4/1983 | Allen et al. | 38/8 |
| 4,738,440 | A * | 4/1988 | Weir | 270/45 |
| 5,079,867 | A * | 1/1992 | Kober et al. | 38/2 |
| 7,017,291 | B2 * | 3/2006 | Borucki | 38/143 |

FOREIGN PATENT DOCUMENTS

| | | |
|---|---|---|
| JP | S62-130600 | 8/1987 |
| JP | S63-177500 | 11/1988 |
| JP | 10-297767 | 11/1998 |
| JP | 2001-113100 | 4/2001 |
| JP | 2007-105067 | 4/2007 |

* cited by examiner

*Primary Examiner* — Ismael Izaguirre
(74) *Attorney, Agent, or Firm* — Bacon & Thomas, PLLC

(57) ABSTRACT

A cloth piece treating apparatus includes a spreading device for spreading a large area cloth piece, a press device, a folding device for folding the cloth piece into a predetermined small size and a cloth piece length measuring device having a cloth piece detector. The spread cloth piece is folded in the folding device on the basis of the length of the spread cloth piece. The cloth piece detector is disposed in the press device so that the horizontal length of a receiving conveyor of the folding device is minimized, whereby the total length of the cloth piece treating apparatus is shortened.

1 Claim, 7 Drawing Sheets

CLOTH PIECE TREATING APPARATUS

TECHNICAL FIELD

The present invention relates to an apparatus for performing a series of cloth piece treatments including spreading a cloth piece having a large area, such as a bed sheet or a cover fabric, using a spreading device, pressing the spread cloth piece using a press device, and then folding the pressed spread cloth piece into a predetermined small size using a folding device.

BACKGROUND ART

In laundry factories, cloth pieces with large areas such as bed sheets and cover fabrics are, after having been washed and dried, successively subjected to a spreading treatment with a spreading device, a press treatment (ironing) with a press device, and a folding treatment with a folding device. A predetermined number (such as 7 to 10 pieces) of the folded cloth pieces are packaged and delivered to customers.

Bed sheets used in hotels and guesthouses have various sizes depending on the bed sizes. Among them, a king size sheet in a spread state as shown in FIG. 4(A) generally has a length W of about 3 m in the longer length direction (right-to-left direction) and a length $L_1$ of about 2 m in the shorter length direction (vertical direction). Some customers may also use a super king size sheet $Y_0$ (as shown by the two dotted line in FIG. 4(A)) having right-to-left length W and vertical length $L_0$ of each about 3 m. In the following description, the right-to-left direction and vertical direction of the cloth piece in the states shown in FIGS. 4(A) to 4(F) are occasionally referred to as transverse direction and longitudinal direction, respectively.

When such a king size sheet Y is folded into a small size, steps shown in (A) to (F) of FIG. 4 are generally carried out. Namely, the cloth piece Y after having been pressed is first folded into four (this is generally done by twice folding the cloth piece into two but is occasionally achieved by a single four-folding step) with a folding device along the three folding lines "a" (transverse lines) to obtain a folded cloth piece $Y_1$, as shown in FIG. 4(B), having ¼ size of the original. This is next folded into two along the folding line "b" (longitudinal line) shown in FIG. 4(B) to obtain a folded cloth piece $Y_2$, as shown in FIG. 4(C), having ⅛ size of the original. The resulting product is then folded into two along the folding line "c" shown in FIG. 4(C) to obtain a folded cloth piece $Y_3$, as shown in FIG. 4(D), having 1/16 size of the original, and further folded into two along the folding line "d" shown in FIG. 4(D) to obtain a finally folded cloth piece $Y_4$, as shown in FIG. 4(E), having 1/32 size of the original. Such finally folded cloth pieces $Y_4$ are successively stacked on a stacking conveyor 44 as shown in FIG. 4(F). The stack Z of the folded cloth pieces consisting of, for example, 7 to 10 pieces is delivered to a succeeding step such as a packaging step.

In laundry factories, an apparatus for performing a series of cloth piece treatments as shown in FIG. 5 is used for folding a large area cloth piece such as a bed sheet, which has been washed and dried, into a predetermined small size. The cloth piece treating apparatus shown in FIG. 5 includes a spreading device 5 for spreading the large area cloth piece, which has been washed and dried, into a rectangular form, a press device 6 for pressing (ironing) the spread cloth piece Y, and a folding device 1 for folding the spread and pressed cloth piece Y into a predetermined small size. These devices are continuously arranged in series. Further, a stacking device 4 for stacking a predetermined number of folded cloth pieces is disposed continuously with the folding device 1. With such a cloth piece treating apparatus, washed and dried large area cloth pieces, when fed to the spreading device 5, are automatically subjected to each of the succeeding steps.

The spreading device 5 has a spreader 50 and a carry-out conveyor 51. The press device 6 has two, upstream-side and downstream-side rollers 62 and 62 (the press device having three rollers may also be used) disposed in a drying kiln 61. The folding device 1, which will be described in detail hereinafter, has a plurality of conveyors, including a receiving conveyor (first conveyor 11), disposed between left and right frames 10 and 10. A plurality of folders, including a first folder 21, are provided in predetermined locations of respective conveyors. The stacking device 4, which will be described in detail hereinafter, is disposed adjacent to an upper side portion of the folding device 1.

The apparatus for performing a series of the cloth piece treatments is operated such that the transfer speed of the cloth piece through the spreading device 5, press device 6 and folding device 1 is the same. However, the cloth piece transfer speed of the cloth piece treating apparatus may be adjustably changed within a range of 10 m/min to 60 m/min depending upon the kind of the cloth piece to be treated (for example, a cloth piece such as a cover fabric having two superposed layers, a cloth piece such as a bed sheet having a single layer, and a cloth piece having varying thickness). For example, in the case of a cloth piece such as a cover fabric having two superposed layers (or a cloth piece having a large thickness), the transfer speed of the cloth piece treating apparatus is made slow (for example, 10 m/min to 30 m/min), because it takes a long time to dry the cloth piece in the press device 6. In the case of a cloth piece such as a bed sheet having a single layer (a cloth piece having a small thickness, in particular), on the other hand, the transfer speed of the cloth piece treating apparatus is increased (for example, to 40 m/min to 60 m/min) because the drying time in the press device 6 is slow.

The present applicant already developed a folding device 1 as shown in FIG. 6 and FIG. 7 for use in an apparatus for performing a series of the cloth piece treatments. The folding device 1 shown in FIGS. 6 and 7 is disclosed in Patent Document 1 (FIGS. 6 and 5 of *Japanese Unexamined Patent Publication No.* 2007-105067).

The known folding device 1 shown in FIG. 6 and FIG. 7 is designed such that a sheet (spread cloth piece) $Y_0$ having the expected maximum size (in which the width W and the length $L_0$ in FIG. 4(A) and FIG. 5 are each about 3 m) can be suitably folded. The structure of the known device is described below.

The folding device 1 shown in FIG. 6 and FIG. 7 is provided with a total of nine conveyors including a first conveyor (receiving conveyor) 11 configured to receive a spread cloth piece Y (or $Y_0$) from the press device 6, a second conveyor 12 provided adjacent to a terminal end portion of the first conveyor 11, a third conveyor 13 disposed for contact with a lower running section of the first conveyor 11, a fourth conveyor 14 disposed for contact with a lower running section of the third conveyor 13, a fifth conveyor 15 continuous with the fourth conveyor 14, a pair of a sixth conveyor 16 and a seventh conveyor 17 configured to grasp a cloth piece to be folded (cloth piece $Y_1$ folded into four as shown in FIG. 4(B)) therebetween at an intermediate portion of the fifth conveyor 15, an eighth conveyor 18 disposed beneath the paired conveyors 16 and 17, and a ninth conveyor 19 disposed adjacent to an upper part of the eighth conveyor 18. The first to fifth conveyors 11 to 15 are supported between right and left frames 10 and 10.

The folding device 1 is also provided with a total of five folders including a first folder 21 (FIG. 6) provided between a terminal end portion of the first conveyor 11 and a starting end portion of the second conveyor 12 for folding the spread cloth piece Y (or $Y_0$) into two, a second folder 22 (FIG. 6) provided between a terminal end portion of the third conveyor 13 and a starting end portion of the fourth conveyor 14 for folding the two-folded cloth piece into a cloth piece ($Y_1$ of FIG. 4(B)) folded into four, a third folder 23 for folding the four-folded cloth $Y_1$ conveyed on the fifth conveyor 15 into a cloth piece ($Y_2$ of FIG. 4(C)) folded into eight, a fourth folder 24 provided between the eighth conveyor 18 and the ninth conveyor 19 for folding the eight-folded cloth $Y_2$ into a cloth piece ($Y_3$ of FIG. 4(D)) folded into sixteen, and a fifth folder 25 provided adjacent to a starting end portion of a delivery device 3 (a pair of grasping conveyors 31 and 32) for folding the sixteen-folded cloth $Y_3$ into a cloth piece ($Y_4$ of FIG. 4(E)) folded into thirty two. Each of the folders 21 to 25 is operated by extending and retracting a pushing plate with an air cylinder to fold a cloth piece into two at a half length portion in the transfer direction thereof.

The finally folded cloth piece ($Y_4$ as shown in FIG. 4(E)) is transferred through the delivery device 3 to the stacking device 4. The delivery device 3 has a pair of grasping conveyors 31 and 32 configured to receive the finally folded cloth piece $Y_4$, folded in the fifth folder 25, in starting end portions of the both conveyors 31 and 32. The folded cloth piece $Y_4$ is then transferred to the stacking device 4 while being grasped between the two grasping conveyors 31 and 32.

The stacking device 4 has a pair of gate plates 41 and 41, an open/close device 42 for opening and closing the both gate plates, and a feed conveyor 43 operable to feed the folded cloth piece Y above the both gate plates 41 and 41. At a location just beneath and spaced from the both gate plates 41 and 41 is disposed a stacking conveyor 44 on which folded cloth pieces Y are successively stacked. The stacking conveyor 44 has a terminal end portion to which a withdrawing conveyor 45 is connected. A working table 46 is disposed at a terminal end portion of the withdrawing conveyor 45.

The second conveyor 12, which is configured to run in both directions by means of a motor 12*a*, is normally operated to run in the same direction (to the rear direction) as that of the first conveyor 11. When the half length position of the spread cloth piece Y (or $Y_0$) which is conveyed on the first conveyor 11 arrives at the folding position of the first folder 21, however, a signal is generated from a controller 70 so that the second conveyor 12 runs in the opposite direction (front direction).

The cloth piece treating apparatus of FIG. 5 is adapted to treat spread cloth pieces with different sizes one by one. The first folder 21 of the folding device 1 is operable to precisely fold the cloth piece Y (or $Y_0$), conveyed in a spread state, into two at the half length position thereof. In order to achieve this, it is necessary to measure the length (in the transfer direction) of each of the spread cloth pieces successively fed from the press device 6, before the half length position thereof arrives at the first folder 21 (first folding position Q) of the folding device 1.

The known apparatus uses a device 7 for measuring the length of the spread cloth piece as shown in FIG. 6, which has a cloth piece detector 71 (such as a photoelectric tube) for detecting a leading edge Ya and a trailing edge Yb of the spread cloth piece Y (or $Y_0$) transferred from the press device 6. The length ($L_1$ or $L_0$) of the spread cloth piece Y (or $Y_0$) in the transfer direction thereof is determined by the controller 70 from the period of time between the detection of the leading and trailing edges Ya and Yb of the spread cloth piece Y (or $Y_0$) by the cloth piece detector 71 and the transfer speed of the cloth piece.

The cloth piece detector 71 generates an ON signal upon detecting the leading edge Ya of the spread cloth piece and generates an OFF signal upon detecting the trailing edge Yb of the spread cloth piece. The ON and OFF signals from the cloth piece detector 71 are inputted to controller 70. The controller 70 measures the time period between the detection of the leading and trailing edges Ya and Yb of the spread cloth piece by the cloth piece detector 71 (the time period over which the cloth piece detector 71 is in the ON state).

On the other hand, the transfer speed of the cloth piece in the folding device 1 is measured by, for example, inputting to the controller 70 the driving speed of a motor 72 that drives the first conveyor 11.

Thus, the length of the spread cloth piece Y (or $Y_0$) in the transfer direction thereof is computed in an operating part of the controller 70 from the time period between the detection of the leading and trailing edges Ya and Yb of the spread cloth piece by the cloth piece detector 71 (the time period over which the cloth piece detector 71 is in the ON state) and the transfer speed of the cloth piece (driving speed of the motor 72) in that period. For example, when the transfer speed of the cloth piece is 60 m/min (maximum speed) and the time period over which the cloth piece detector 71 is in the ON state is 2 seconds, then the length of the spread cloth piece in the transfer direction thereof is calculated to be 2 m (length $L_1$ in FIG. 4(A) and FIG. 5). Similarly, when the transfer speed of the cloth piece is 60 m/min and the time period over which the cloth piece detector 71 is in the ON state is 3 seconds, then the length of the spread cloth piece in the transfer direction thereof is calculated to be 3 m (length $L_0$ in FIG. 4(A) and FIG. 5). When the period of time required for the half length position of the spread cloth piece to arrive at the folding position Q of the first folder 21 has elapsed after the length of the spread cloth piece in its transfer direction was measured, the first folder 21 receives a signal from the controller 70 and starts operating. At the same time, the second conveyor 12 starts running in the opposite direction so that the spread cloth piece is folded into two at the half length portion.

In order to precisely fold the cloth piece Y (or $Y_0$) into two at the half length position thereof by first folder 21 of the folding device 1, it is necessary to previously measure the length $L_1$ (or $L_0$) in the transfer direction of the spread cloth piece Y (or $Y_0$). Since the length of the cloth piece is determined by calculation from the time period between the detection of the leading and trailing edges Ya and Yb of the spread cloth piece by the cloth piece detector 71, it is essential that, at a time point at which the cloth piece detector 71 has detected the trailing edge Yb, the half length position of the spread cloth piece (the position at which the cloth piece is to be folded into two) has not yet arrived at the folding position Q of the first folder 21. For example, when the spread cloth piece of a super king size has a length $L_0$ of 3 m, it is necessary that the cloth piece detection position by the cloth piece detector 71 (namely, position P at which the detector is disposed) should be spaced apart a distance R, which is greater than the half length (1.5 m by simple calculation) of the spread cloth piece $Y_0$ (with a length $L_0$ of 3 m), from the first folding position Q toward the front side. In actual, the spacing distance R is set at about 70% (about 2.1 m) of the expected maximum length (3 m) of the cloth piece $Y_0$ in view of possible delays in response of the cloth piece detector 71, in computation and output of the controller 70 and in response of the first folder 21. As long as the spacing distance R is set at 2.1 m, even when the cloth piece with the maximum length (3 m) is treated with the highest speed (60 m/min), a time of 0.6 second (time required for displacing a distance of 0.6 m (2.1 m-1.5 m) at a speed of 60 m/min) is available from the time point at which the terminal edge Yb is detected by the cloth detector 71 to the time point at which the half length position (position at which the cloth piece is to be folded into two) of the spread cloth piece arrives at the folding position Q of the first folder 21. Therefore, even when the apparatus is operated under the most severe conditions (the cloth piece with the maximum length of 3 m is treated at the highest transfer speed of 60 m/min), it is possible to precisely fold the cloth piece into two after the measurement of the length thereof (delays in response of respective devices may be absorbed). Stated otherwise, with the cloth piece treating apparatus of the above-described type, it is necessary that the spacing distance R between the position P at which the cloth piece detector 71 is disposed and the folding position Q by the first folder 21 of the folding device 1 should be at least slightly greater than 2 m (2.1 m in the case of the above case) in order to match with the case in which the cloth piece with the longest length of 3 m is treated at the highest transfer speed of 60 m/min.

In the known cloth piece treating apparatus shown in FIG. 5 to FIG. 7, the cloth piece detector 71 of the cloth piece length measuring device 7 is disposed in the folding device 1 (above the first conveyor 11). In this case, because the spacing distance R between the detector position P and the first folding position Q is about 2.1 m as described above, it is unavoidable to locate the detector position P at a position significantly forward (front side) of the folding device 1 even when the first folder 21 is disposed at a position significantly rear side of the folding device 1 as seen in FIG. 5 and FIG. 6.

Thus, in the known cloth piece treating apparatus shown in FIG. 5 and FIG. 6, since the cloth piece detector 71 is disposed at a position above the first conveyor 11 of the folding device 1, it is necessary that the length $E_1$ (FIG. 5) of the first conveyor 11 should exceed 2.1 m ($E_1$=about 2.2 m). As a consequence, the starting end portion 11*a* of the first conveyor 11 should extend significantly forward (front side). In particular, in the embodiment shown in FIG. 5, the starting end portion 11*a* of the first conveyor 11 extends forward (toward front side) to a position a length of F (F=about 70 cm) from a front edge 10*a* of the frame 10. Thus, in the cloth piece treating apparatus shown in FIG. 5 and FIG. 6, the front to rear length $C_1$ of the folding device 1 (including the stacking device 4, carry-out conveyor 45 and working table 46 which are disposed continuously with the folding device 1) is as long as about 3.7 m.

Patent Document 1: Japanese Unexamined Patent Publication No. 2007-105067 (FIG. 5 and FIG. 6)

DISCLOSURE OF THE INVENTION

Problems to be Solved by the Invention

The apparatus for performing a series of treatments as shown in FIG. 5 has a total length $D_1$ which is a sum of length A of the spreading device 5 (total length of the spreader body 50 and its associated carry-out conveyor 51), length B of the press device 6 and length $C_1$ of the folding device 1 (length between the starting end portion 11*a* of the first conveyor and the terminal end portion of the working table 46). The length $D_1$ of the apparatus represents a length of the floor space of a laundry factory that is to be occupied by the apparatus. In the specific embodiment shown in FIG. 5, the length A of the spreading device 5 is about 4.3 m, the length B of the press device 6 is about 2.3 m, and the length $C_1$ of the folding device 1 (length between the starting end portion 11*a* of the first conveyor and the terminal end portion of the working table 46) is about 3.7 m, so that the total length $D_1$ of the cloth piece treating apparatus is about 10.3 m.

Therefore, the known cloth piece treating apparatus shown in FIG. 5 to FIG. 7 requires a large floor occupying area in the longitudinal direction and poses a problem that a free space in the factory is reduced.

It is, therefore, an object of the present invention to provide a cloth piece treating apparatus having a series of continuously arranged spreading device, press device and folding device, in which the entire length of the folding device is shortened by using a specific configuration capable of shorting the length of the folding device so that the floor occupying area in the longitudinal direction of the cloth piece treating apparatus is reduced.

Means for Solving the Problem

In accomplishing the above-described object, the present invention has the following configuration.

The present invention is concerned with a cloth piece treating apparatus that is configured to spread a large area cloth piece such as a bed sheet in a spreading device, to press the spread cloth piece in a press device, to thereafter transfer the pressed, spread cloth piece to a folding device, and to successively fold the pressed, spread cloth piece into a predetermined small size.

The spreading device of the cloth piece treating apparatus has a carry-out conveyor which is continuous with an inlet of the press device. The press device has an outlet which is continuous with a starting end portion of a receiving conveyor (first conveyor) of the folding device. The cloth piece treating apparatus is configured to automatically successively perform each of the steps (spreading treatment, press treatment and folding treatment), when large area cloth pieces, which have been washed and dried, are fed to the spreading device.

The cloth piece treating apparatus of the present invention is configured to successively fold each of the spread cloth pieces, carried out from the press device, at predetermined lengthwise positions using folders of the folding device on the basis of the length of each spread cloth piece in the transfer direction thereof. The length in the transfer direction of the spread cloth piece is previously measured with a device for measuring the cloth piece length. The cloth piece length measuring device is configured to measure the length of the spread cloth piece in the transfer direction by computation in a controller from the time period from the detection of the leading edge to the detection of the trailing edge of the spread cloth piece by the cloth piece detector and the transfer speed of the cloth piece. The cloth piece length measuring device of this type has been conventionally widely used in cloth piece folding devices.

The cloth piece treating apparatus of this type should be adapted to treat a large area cloth piece (bed sheet) of a super king size having longitudinal and transverse lengths of each about 3 m. In order to fold such a super king size spread cloth piece (having a length of 3 m in the transfer direction) at an intended position at which the cloth piece is folded into two (half length position), it is necessary to measure the length of the spread cloth piece in the transfer direction before the intended position of the spread cloth piece at which it is folded into two arrives at the first folding position of the first folder. In order to measure the length of the spread cloth piece in the transfer direction, it is necessary that the position, at which the cloth piece detector of the cloth piece length measuring device is disposed, should be spaced apart a distance that is greater than the half length (1.5 m) of the spread cloth piece in its transfer direction from the folding position of the first folder toward the front side. Since the length of the maximum spread cloth piece (with a super king size) to be treated is about 3 m in the transfer direction, it is theoretically sufficient that spacing distance between the position at which the detector is disposed and first folding position exceeds 1.5 m. In actual, however, the spacing distance is approximately in the range of 2.0 m to 2.2 m in view of possible delays in response of respective devices such as the cloth piece detector, computation section of the controller and the first folder.

In the case of the above-described known cloth piece treating apparatus shown in FIG. 5 and FIG. 6, since the cloth piece detector is disposed at a position above the receiving conveyor (first conveyor) of the folding device, the length from the first folding position of the first folder to the starting end portion of the receiving conveyor of the folding device (position at which the detector is disposed) is long so that the entire length of the folding device is long (floor occupying length of the cloth piece treating apparatus as a whole is long).

In the cloth piece treating apparatus according to the present invention, the cloth piece detector of the cloth piece length measuring device is disposed in the press device so that the length of the receiving conveyor of the folding device in the horizontal direction is made as short as possible. The term "length of the receiving conveyor of the folding device in the horizontal direction" is intended to refer to a length in the horizontal direction between the starting end portion of the receiving conveyor and the first folding position of the first folder.

Because the cloth piece detector of the cloth piece length measuring device is disposed in the press device which performs a previous step before the folding device, it is possible to significantly increase the spacing distance between the position at which the cloth piece detector is disposed and first folding position of the first folder of the folding device. Therefore, it is no longer necessary to provide a long distance between the first folding position and the starting end portion of the receiving conveyor of the folding device as is the case with the above-described known apparatus. Accordingly, the length of the receiving conveyor of the folding device in the horizontal direction may be shortened. The reduction of the receiving conveyor length results in a reduction of the entire length of the folding device.

Because, in the present invention, the cloth piece detector is disposed in the press device, the spacing distance between the position at which the cloth piece detector is disposed and the first folder of the folding device (first folding position) can be greatly increased to, for example, 3 m or more, as compared with the necessary spacing distance (about 2.1 m) in order to match with the maximum size spread cloth piece (3 m). However, since the folding device is provided with a plurality of other folders than the first folder, the required length between the front end of the folding device (starting end portion of the receiving conveyor) and the first folder (first folding position) is, for example, about 1.5 m. Thus, the passage "the length of the receiving conveyor of the folding device in the horizontal direction is made as short as possible" as used herein is not intended to refer to "the spacing distance between the position at which the cloth piece detector is disposed in the press device and the position of the first folder of the folding device (first folding position) is shortened to the allowable limit", but is rather intended to mean "the horizontal length of the receiving conveyor is made as short as possible while ensuring the required spacing distance (about 1.5 m) between the front end of the folding device (starting end portion of the receiving conveyor) and the first folder (first folding position).

Effect of the Invention

Since, in the cloth piece treating apparatus according to the present invention, the cloth piece detector of the cloth piece length measuring device is disposed in the press device so that the length of the receiving conveyor of the folding device in the horizontal direction is made as short as possible, the entire length of the folding device is shortened so that entire length of the cloth piece treating apparatus is reduced. Thus, the floor occupying area of the cloth piece treating apparatus is reduced (free floor area in the factory increases in a degree corresponding to the reduction of the length of the folding device). In particular, the cloth piece treating apparatus according to the present invention has a length which is shorter by 70 cm than the total length $D_1$ (about 10.3 m) of the known cloth piece treating apparatus (FIG. 5).

PREFERRED EMBODIMENTS

A cloth piece treating apparatus according to an embodiment of the present invention will be described below with reference to FIG. 1 to FIG. 3 (reference should be also made to FIG. 4). The basic configuration of the cloth piece treating apparatus according to the embodiment is generally similar to the known one shown in FIG. 5 to FIG. 7. The configuration of the embodiment of the present invention will be described below, though the description will overlap with that of the known embodiment.

The cloth piece treating apparatus shown in FIG. 1 includes a spreading device 5 for spreading a large area cloth piece, which has been washed and dried, into a rectangular form, a press device 6 for pressing (ironing) the spread cloth piece Y, and a folding device 1 for folding the pressed cloth piece Y into a predetermined small size. These devices are continuously arranged in series. Further, a stacking device 4 for stacking a predetermined number of folded cloth pieces is disposed continuously with the folding device 1. With such a cloth piece treating apparatus, washed and dried large area cloth pieces, when fed to the spreading device 5, are automatically subjected to each of the succeeding steps.

The spreading device 5 of the cloth piece treating apparatus has a spreader 50 and a carry-out conveyor 51. The press device 6 has two, upstream-side and downstream-side rollers 62 and 62 (the press device having three rollers may also be used) disposed in a drying kiln 61. The folding device 1 has a configuration as described hereinafter.

The apparatus for performing a series of the cloth piece treatments is operated such that the transfer speed of the cloth piece through the spreading device 5, press device 6 and folding device 1 is the same. However, the cloth piece transfer speed in the cloth piece treating apparatus may be adjustably changed within a range of 10 m/min to 60 m/min depending upon the kind of the cloth piece to be treated (for example, a cloth piece such as a cover fabric having two superposed layers, a cloth piece such as a bed sheet having a single layer, and a cloth piece having varying thickness). For example, in the case of a cloth piece such as a cover fabric having two superposed layers (or a cloth piece having a large thickness), the transfer speed in the cloth piece treating apparatus is made slow (for example, 10 m/min to 30 m/min), because it takes a long time to dry the cloth piece in the press device 6. In the case of a cloth piece such as a bed sheet having a single layer (a cloth piece having a small thickness, in particular), on the other hand, the transfer speed in the cloth piece treating apparatus is increased (for example, to 40 m/min to 60 m/min) because the drying time in the press device 6 is short.

The folding device 1 of the apparatus for performing a series of the cloth piece treatment shown in FIG. 1 is provided with a total of nine conveyors, as shown in FIG. 2 and FIG. 3, including a first conveyor (receiving conveyor) 11 configured to receive a spread cloth piece Y (or $Y_0$) from an outlet of the press device 6, a second conveyor 12 provided adjacent to a terminal end portion of the first conveyor 11, a third conveyor 13 disposed for contact with a lower running section of the first conveyor 11, a fourth conveyor 14 disposed for contact with a lower running section of the third conveyor 13, a fifth conveyor 15 continuous with the fourth conveyor 14, a pair of a sixth conveyor 16 and a seventh conveyor 17 configured to grasp a cloth piece to be folded (cloth piece $Y_1$ folded into four as shown in FIG. 4(B)) therebetween at an intermediate portion of the fifth conveyor 15, an eighth conveyor 18 disposed beneath the paired conveyors 16 and 17, and a ninth conveyor 19 disposed adjacent to an upper part of the eighth conveyor 18. The first to fifth conveyors 11 to 15 are supported between right and left frames 10 and 10.

The folding device 1 is also provided with a total of five folders including a first folder 21 (FIG. 2) provided between a terminal end portion of the first conveyor 11 and a starting end portion of the second conveyor 12 for folding the spread cloth piece Y (or $Y_0$) into two, a second folder 22 (FIG. 2) provided between a terminal end portion of the third conveyor 13 and a starting end portion of the fourth conveyor 14 for folding the two-folded cloth piece into a cloth piece ($Y_1$ of FIG. 4(B)) folded into four, a third folder 23 (FIG. 2 and FIG. 3) for folding the four-folded cloth $Y_1$ conveyed on the fifth conveyor 15 into a cloth piece ($Y_2$ of FIG. 4(C)) folded into eight, a fourth folder 24 (FIG. 3) provided between the eighth conveyor 18 and the ninth conveyor 19 for folding the eight-folded cloth $Y_2$ into a cloth piece ($Y_3$ of FIG. 4(D)) folded into sixteen, and a fifth folder 25 (FIG. 3) provided adjacent to a starting end portion of a delivery device 3 (a pair of grasping conveyors 31 and 32) for folding the sixteen-folded cloth $Y_3$ into a cloth piece ($Y_4$ of FIG. 4(E)) folded into thirty two. Each of the folders 21 to 25 is operated by extending and retracting a pushing plate with an air cylinder to fold a cloth piece into two at a half length portion in the transfer direction thereof.

The finally folded cloth piece ($Y_4$ as shown in FIG. 4(E)) is transferred through the delivery device 3 to the stacking device 4. The delivery device 3 has a pair of grasping conveyors 31 and 32 configured to receive the thirty two-folded (finally folded) cloth piece $Y_4$ folded in the fifth folder 25 in starting end portions of the both conveyors 31 and 32. The folded cloth piece $Y_4$ is then transferred to the stacking device 4 while being grasped between the two grasping conveyors 31 and 32.

The stacking device 4 has a pair of gate plates 41 and 41, an open/close device 42 for opening and closing the both gate plates, and a feed conveyor 43 operable to feed the folded cloth piece Y above the both gate plates 41 and 41. At a location just beneath and spaced from the both gate plates 41 and 41 is disposed a stacking conveyor 44 on which folded cloth pieces Y are successively dropped and stacked. The stacking conveyor 44 has a terminal end portion to which a withdrawing conveyor 45 is connected. A working table 46 is disposed at a terminal end portion of the withdrawing conveyor 45.

The second conveyor 12, which is configured to run in both directions by means of a motor 12*a*, is normally operated to run in the same direction (to the rear direction) as that of the first conveyor 11. When the half length position of the spread cloth piece Y (or $Y_0$) which is conveyed on the first conveyor 11 arrives at the folding position of the first folder 21, however, a signal is generated from a controller 70 so that the second conveyor 12 runs in the opposite direction (front direction).

The cloth piece treating apparatus of FIG. 1 is adapted to treat spread cloth pieces with different sizes one by one. The first folder 21 of the folding device 1 is operable to precisely fold the cloth piece Y (or $Y_0$), conveyed in a spread state, into two at the half length position thereof. In order to achieve this, it is necessary to measure the length (in the transfer direction) of each of the spread cloth pieces successively fed from the press device 6, before the half length position thereof arrives at the first folder 21 of the folding device 1.

The present apparatus uses a device 7 for measuring the length of the spread cloth piece, as shown in FIG. 2, which has a cloth piece detector 71 (such as a photoelectric tube) for detecting a leading edge Ya and a trailing edge Yb of the spread cloth piece Y (or $Y_0$) transferred from the press device 6. The length ($L_1$ or $L_0$) of the spread cloth piece Y (or $Y_0$) in the transfer direction thereof is determined by the controller 70 from the period of time between the detection of the leading and trailing edges Ya and Yb of the spread cloth piece Y (or $Y_0$) by the cloth piece detector 71 and the transfer speed of the cloth piece.

The cloth piece detector 71 generates an ON signal upon detecting the leading edge Ya of the spread cloth piece and generates an OFF signal upon detecting the trailing edge Yb of the spread cloth piece. The ON and OFF signals from the cloth piece detector 71 are inputted to controller 70. The controller 70 measures the time period between the detection of the leading and trailing edges Ya and Yb of the spread cloth piece by the cloth piece detector 71 (the time period over which the cloth piece detector 71 is in the ON state).

On the other hand, the transfer speed of the cloth piece in the folding device 1 is measured by, for example, inputting to the controller 70 the driving speed of a motor 72 that drives the first conveyor 11.

Thus, the length of the spread cloth piece Y (or $Y_0$) in the transfer direction thereof is computed in an operating part of the controller 70 from the time period between the detection of the leading and trailing edges Ya and Yb of the spread cloth piece by the cloth piece detector 71 (the time period over which the cloth piece detector 71 is in the ON state) and the transfer speed of the cloth piece (driving speed of the motor 72) in that period. For example, when the transfer speed of the cloth piece is 60 m/min (maximum speed) and the time period over which the cloth piece detector 71 is in the ON state is 2 seconds, then the length of the spread cloth piece in the transfer direction thereof is calculated to be 2 m (length $L_1$ in FIG. 4(A) and FIG. 1). Similarly, when the transfer speed of the cloth piece is 60 m/min and the time period over which the cloth piece detector 71 is in the ON state is 3 seconds, then the length of the spread cloth piece in the transfer direction thereof is calculated to be 3 m (length $L_0$ in FIG. 4(A) and FIG. 1). When the period of time required for the half length position of the spread cloth piece to arrive at the folding position Q of the first folder 21 has elapsed after the length of the spread cloth piece in its transfer direction was measured, the first folder 21 receives a signal from the controller 70 and starts operating. At the same time, the second conveyor 12 starts running in the opposite direction so that the spread cloth piece is folded into two at the half length portion.

In order to precisely fold the cloth piece Y (or $Y_0$) into two at the half length position thereof by first folder 21 of the folding device 1, it is necessary to previously measure the length $L_1$ (or $L_0$) in the transfer direction of the spread cloth piece Y (or $Y_0$). Since the length of the cloth piece is determined by calculation from the time period between the detection of the leading and trailing edges Ya and Yb of the spread cloth piece by the cloth piece detector 71, it is essential that, at a time point at which the cloth piece detector 71 has detected the trailing edge Yb, the half length position of the spread cloth piece (the position at which the cloth piece is to be folded into two) has not yet arrived at the folding position Q of the first folder 21. For example, when the spread cloth piece of a super king size has a length $L_0$ of 3 m, it is necessary that the cloth piece detection position by the cloth piece detector 71 (namely, position P at which the detector is disposed) should be spaced apart a distance R, which is greater than the half length (1.5 m by simple calculation) of the spread cloth piece $Y_0$ (with a length $L_0$ of 3 m), from the first folding position Q toward the front side. In actual, the spacing distance R is set at about 70% (about 21 m) of the expected maximum length (3 m) of the cloth piece $Y_0$ in view of possible delays in response of the cloth piece detector 71, in computation and output of the controller 70 and in response of the first folder 21. As long as the spacing distance R is set at 2.1 m, even when the cloth piece with the maximum length (3 m) is treated with the highest speed (60 m/min), a time of 0.6 second (time required for displacing a distance of 0.6 m (2.1 m-1.5 m) at a speed of 60 m/min) is available from the time point at which the terminal edge Yb is detected by the cloth detector 71 to the time point at which the half length position (position at which the cloth piece is to be folded into two) of the spread cloth piece arrives at the folding position Q of the first folder 21. Therefore, even when the apparatus is operated under the most severe conditions (the cloth piece with the maximum length of 3 m is treated at the highest transfer speed of 60 m/min), it is possible to precisely fold the cloth piece into two after the measurement of the length thereof (delays in response of respective devices may be absorbed). Stated otherwise, with the cloth piece treating apparatus of the above-described type, it is necessary that the spacing distance R between the position P at which the cloth piece detector 71 is disposed and the folding position Q by the first folder 21 of the folding device 1 should be at least slightly greater than 2 m (2.1 m in the case of the above-case) in order to match with the case in which the cloth piece with the longest length of 3 m is treated at the highest transfer speed of 60 m/min.

In the embodiment of the present invention shown in FIG. 1 and FIG. 2, the cloth piece detector 71 is disposed between the two, upstream-side and downstream-side rollers 62 and 62 of the press device 6. When the cloth piece detector 71 is disposed between the two rollers 62 and 62 of the press device 6, the position P at which the cloth piece detector 71 is disposed is located at a significantly front side and, hence, the distance $R_0$ between the detector position P and the first folding position Q of the first folder 21 of the folding device 1 can be made longer than the minimum distance ($R_1$=2.1 m in FIG. 5) required in the conventional cloth piece treating apparatus. In the specific embodiment here, the distance $R_0$ in terms of the cloth piece travelling distance is slightly longer than 3 m. As long as the location of thethe cloth piece detector 71 is within a length range B of the press device 6, the cloth piece detector 71 can be disposed at a position more front side as compared with that in the conventional apparatus shown in FIG. 5 and FIG. 6. It is advantageous, however, that the cloth piece detector 71 be located between the two, upstream-side and downstream-side rollers 62 and 62 for reasons of easiness in mounting operation and in detecting cloth pieces.

Since the cloth piece detector 71 is disposed at a position more front side (in the press device) as described above, it is possible to shorten the length $E_0$ of the first conveyor 11 of the folding device 1. In the specific embodiment shown, the length $E_0$ of the first conveyor 11 is about 1.5 m.

Therefore, the cloth piece treating apparatus according to the embodiment shown in FIG. 1 and FIG. 2, the length $E_0$ (1.5 m) of the first conveyor 11 is significantly shorter than the length $E_1$ (2.2 m) of the first conveyor 11 shown in FIG. 5. More specifically, in the embodiment shown in FIG. 1, the starting end portion 11*a* of the first conveyor 11 can be retracted to a position close to a front edge 10*a* of the frame 10; namely, the length of the apparatus is reduced by a length corresponding to the length F (about 70 cm) by which the conveyor in the embodiment shown in FIG. 5 protrudes from the front edge 10*a* of the frame.

Since the length of the first conveyor 11 of the folding device 1 is thus shortened, the entire length of the folding device 1 can be also reduced. In particular, the front to rear length $C_0$ of the folding device 1 (including the stacking device 4, carry-out conveyor 45 and working table 46 which are disposed continuously with the folding device 1) is significantly reduced to about 3.0 m.

In the embodiment shown in FIG. 1, the length A of the spreading device 5 is about 4.3 m, the length B of the press device 6 is about 2.3 m, and the length $C_0$ of the folding device 1 (length up to the working table 46) is about 3.0 m, so that the total length $D_0$ of the cloth piece treating apparatus is about 9.6 m. Thus, the total length $D_0$ of the cloth piece treating apparatus of the embodiment shown in FIG. 1 can be shorter by about 70 cm than the total length $D_1$ (10.3 m) of the known cloth treating apparatus shown in FIG. 5 so that there is obtained an effect that the floor space of a laundry factory which is to be occupied by the apparatus can be reduced.

In the cloth piece treating apparatus of the above embodiment, the cloth piece travelling length from the position P at which the detector is disposed to the first folding position Q is previously inputted in the controller 70. The controller is configured to compute the time period between the detection by the cloth piece detector of the leading and trailing edges Ya and Yb of the spread cloth piece that is conveyed through the press device 6. The length ($L_1$ or $L_0$) of the spread cloth piece in the transfer direction is measured from the computed time period and the peripheral speed of the roller 62 (that is inputted in the controller 70). When the period of time that is required for the position at a half length of the spread cloth piece in the transfer direction to arrive at the folding position Q of the first folder 21 has elapsed after the trailing edge Yb of the cloth piece was detected by the cloth piece detector 71 (the period of time is computed in the controller 70 in consideration of the cloth piece travelling speed), the first folder 21 operates the folding of the cloth piece into two.

EXPLANATION OF REFERENCE NUMERALS

Figure 1:
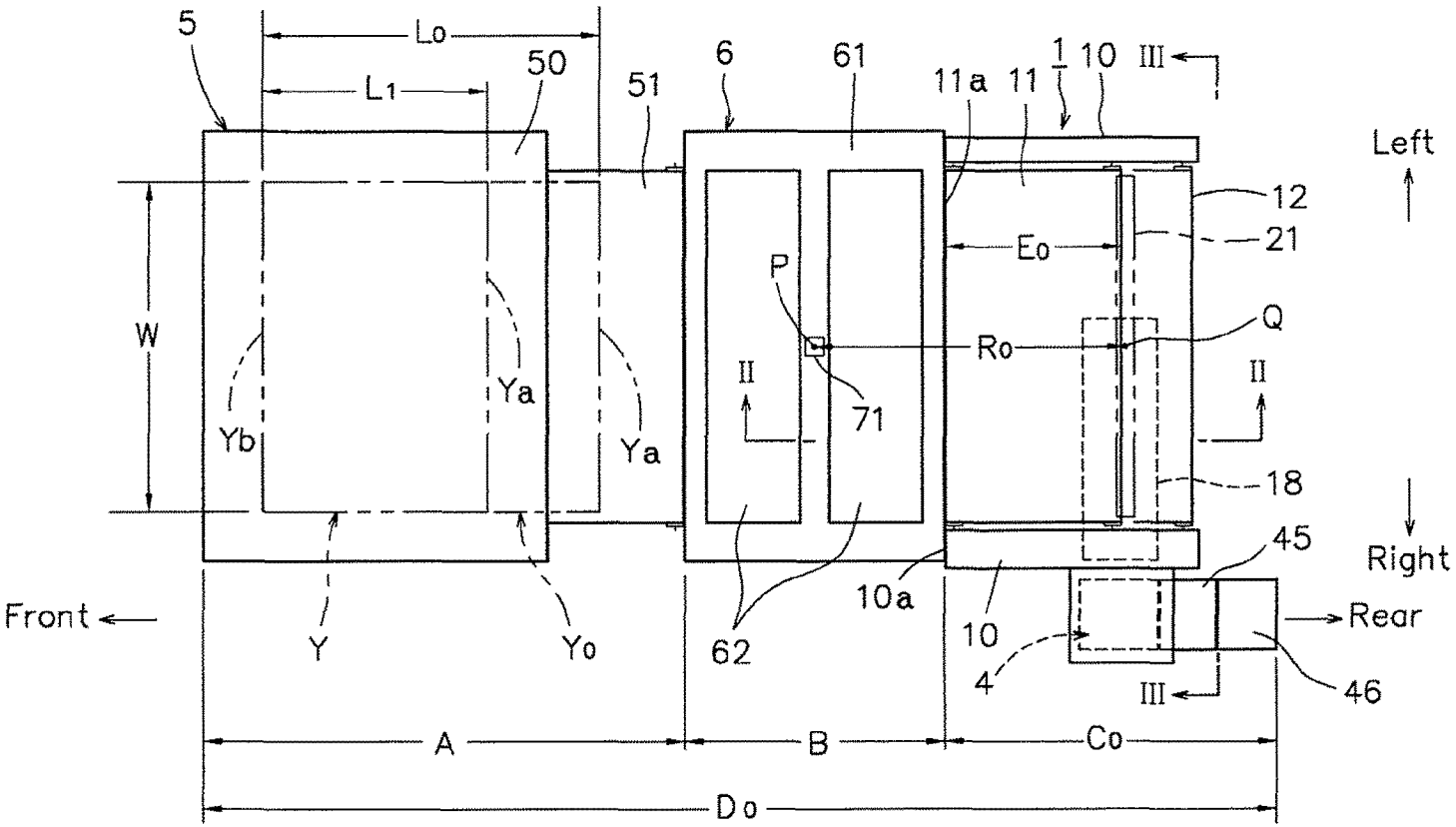
FIG. 1 is a plan view diagramatically illustrating a cloth piece treating apparatus according to one embodiment of the present invention.
Figure 2:
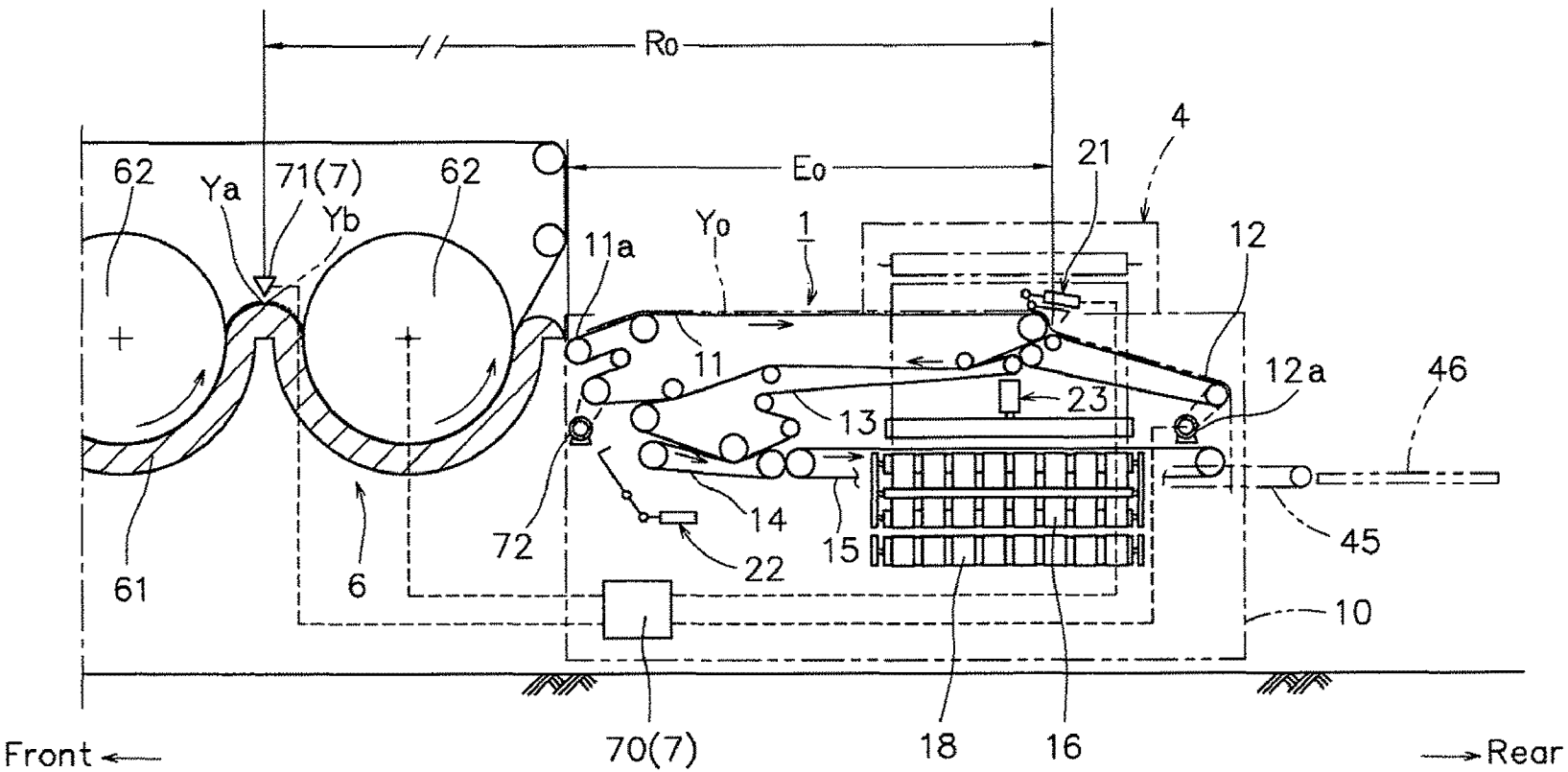
FIG. 2 is a view as seen in the direction of arrows II-II in FIG. 1 (side view of a folding device in the longitudinal direction)
Figure 3:
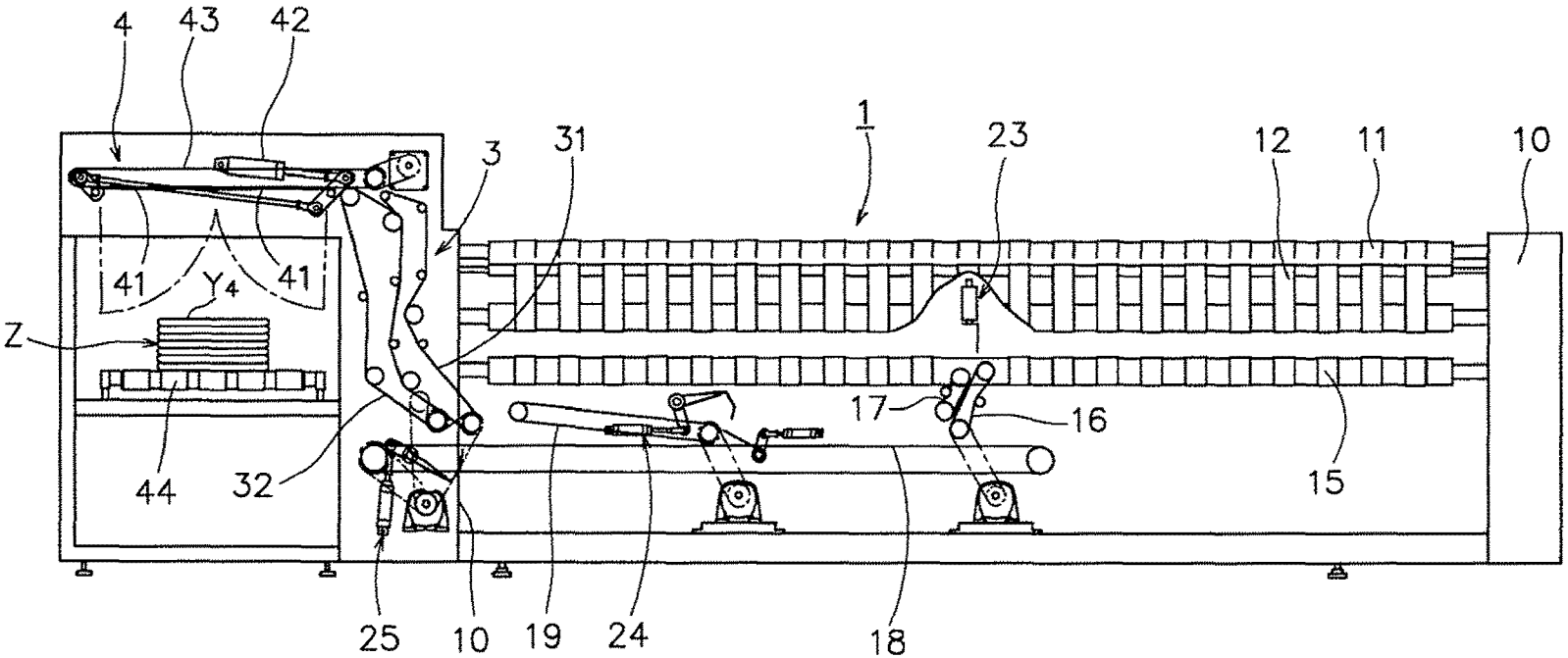
FIG. 3 is a view as seen in the direction of arrows III-III in FIG. 1 (side view of a folding device in the lateral direction)
Figure 4:
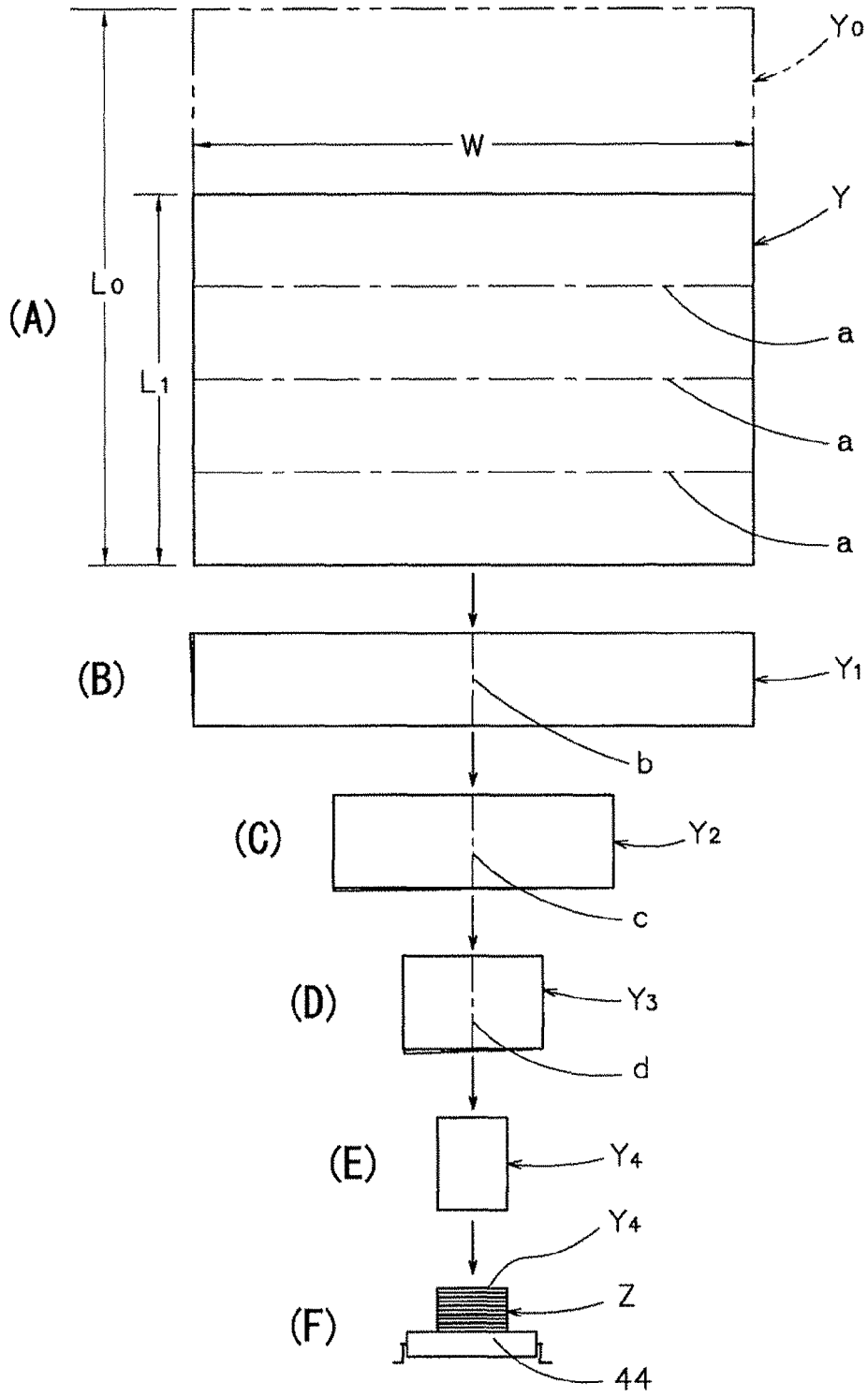
FIG. 4 is an explanatory view of steps of folding a cloth piece to be treated.
Figure 5:
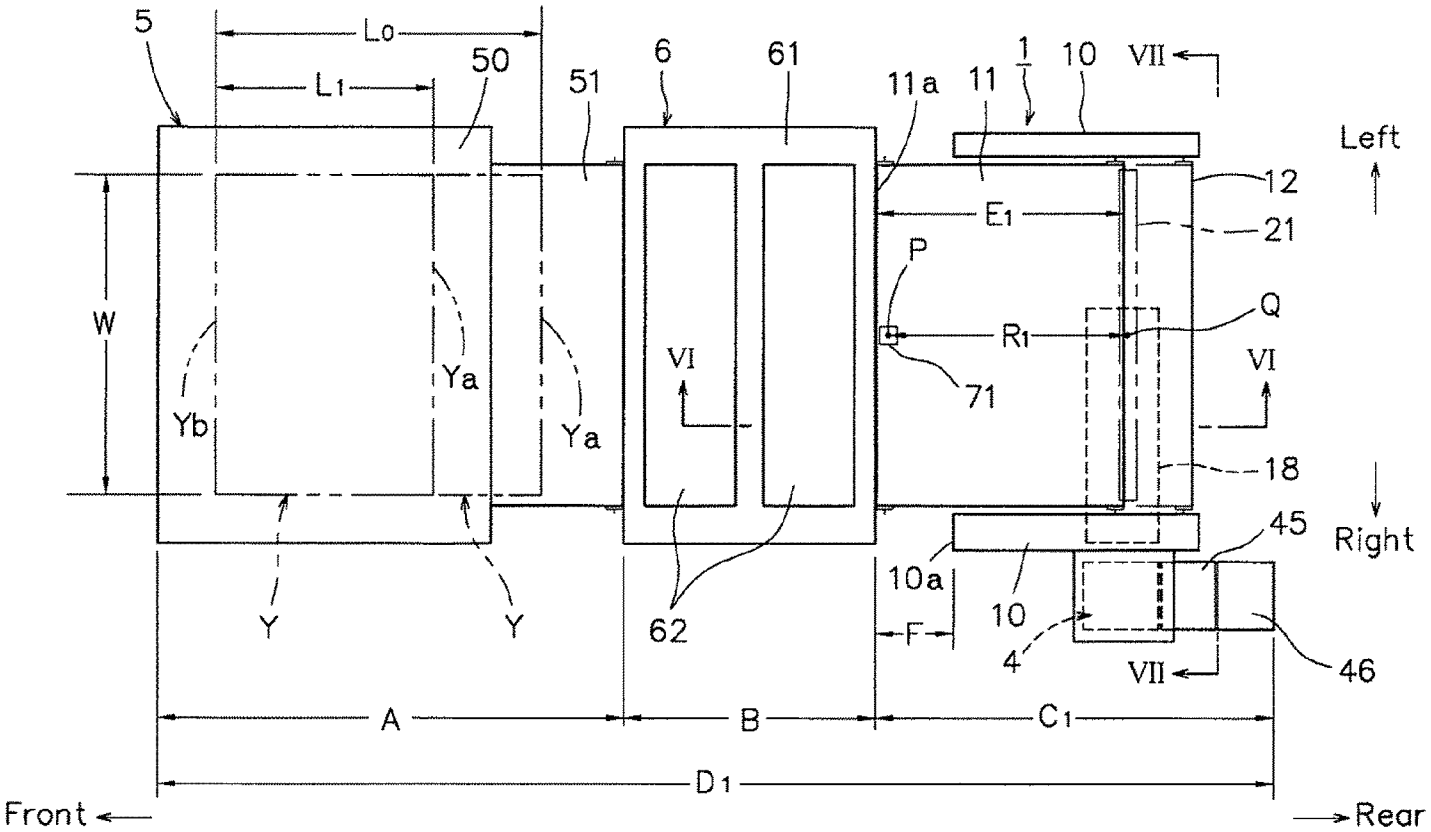
FIG. 5 is a plan view (similar to FIG. 1) diagramatically illustrating a known cloth piece treating apparatus.
Figure 6:
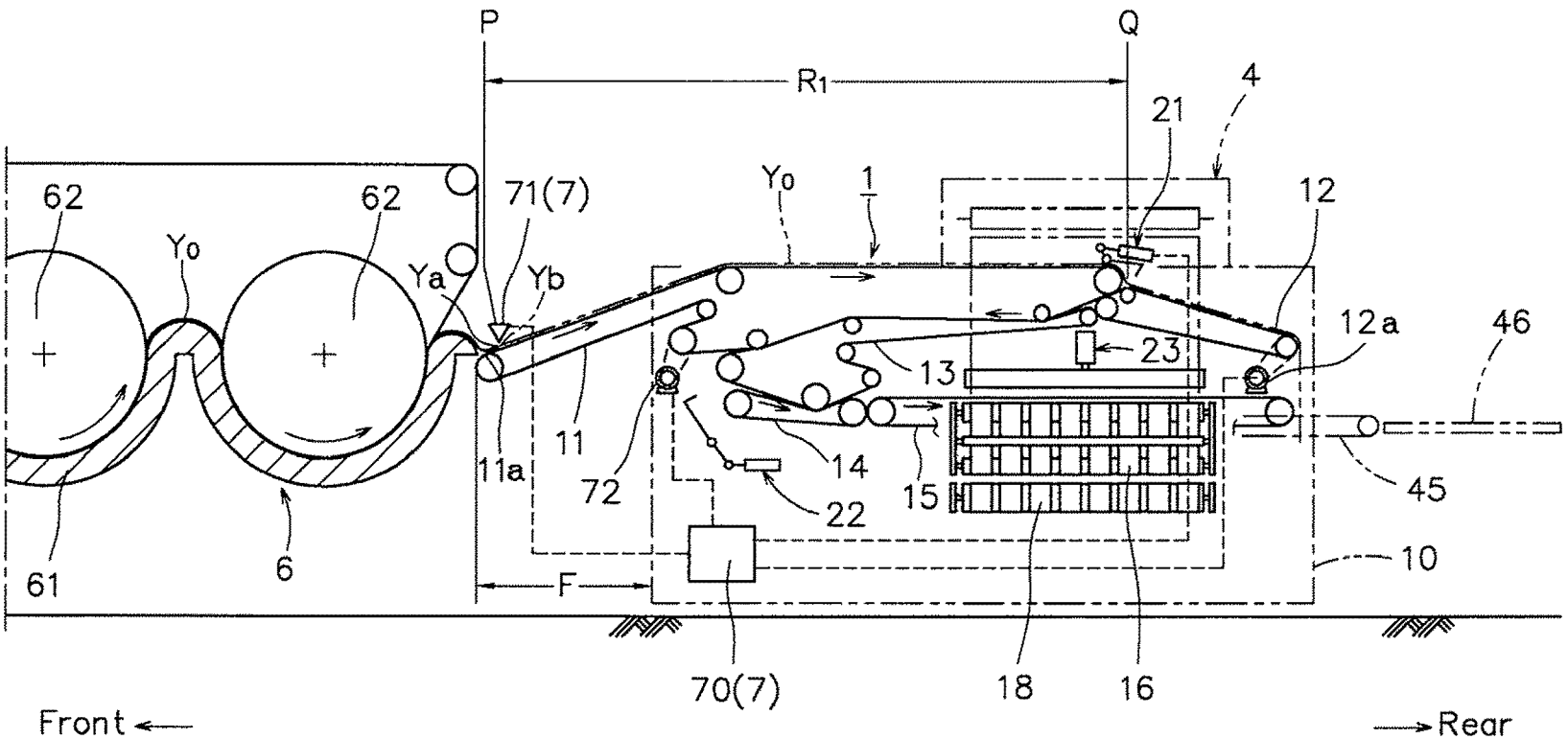
FIG. 6 is a view as seen in the direction of arrows VI-VI in FIG. 5 (similar to FIG. 2)
Figure 7:
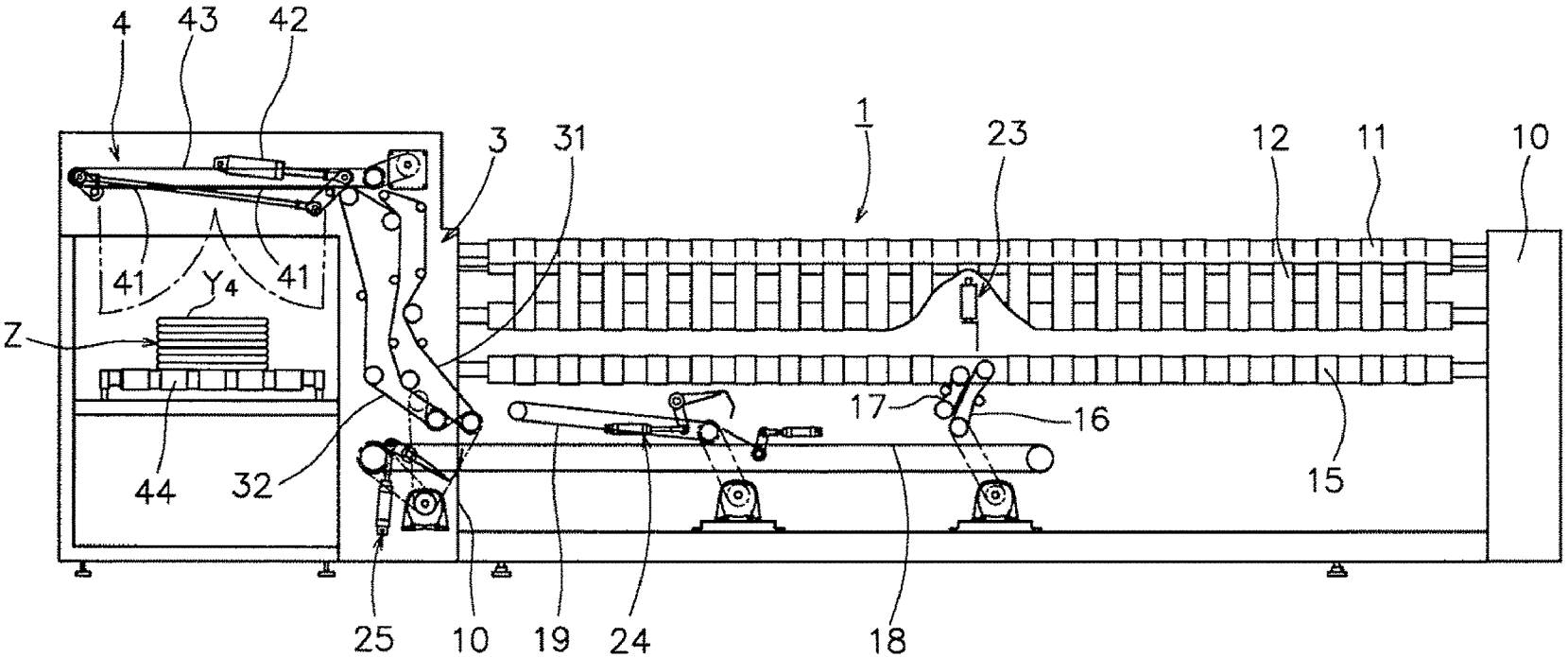
FIG. 7 is a view as seen in the direction of arrows VII-VII in FIG. 5 (similar to FIG. 3).

The reference numeral 1 designates a folding device, 5 a spreading device, 6 a press device, 7 a cloth length measuring device, 10 a frame, 11*a* receiving conveyor (first conveyor),

21*a* first folder, 61*a* drying kiln, 62 a roller, 70 a controller, 71*a* cloth piece detector, P a position at which the detector is disposed, Q a first folding position, $R_0$ a spacing distance, Y and $Y_0$ a spread cloth piece, Ya leading edge of a cloth piece and Yb designates a trailing edge of the cloth piece.

The invention claimed is:

1. A cloth piece treating apparatus comprising:

a spreading device for spreading a large area cloth piece;

a press device for pressing the spread cloth piece;

a folding device for folding the pressed, spread cloth piece into a predetermined small size;

a cloth piece detector, disposed in the press device for detecting the leading, and trailing edges of the spread cloth piece in a transfer direction;

a controller for computing the cloth piece length in the transfer direction based on a time period between the detection of leading and trailing edges of the spread cloth piece by the cloth piece detector and a transfer speed of the cloth piece;

wherein said folding device folds the spread cloth piece on the basis of the computed length of the spread cloth piece; and wherein the cloth piece detector is positioned in the press device to minimize a horizontal length of a receiving conveyor of the folding device.

* * * * *